United States Patent [19]

Ocheskey

[11] Patent Number: 4,805,805

[45] Date of Patent: Feb. 21, 1989

[54] TUBE DISPENSER

[76] Inventor: Glen D. Ocheskey, R-2, Box 331, Eldon, Mo. 65026

[21] Appl. No.: 157,952

[22] Filed: Feb. 19, 1988

[51] Int. Cl.[4] ..... B65D 35/28

[52] U.S. Cl. ..... 222/102; 222/391

[58] Field of Search ..... 222/101, 102, 103, 95, 222/92, 137, 97, 391, 325

[56] References Cited

U.S. PATENT DOCUMENTS

| | | | |
|---|---|---|---|
| D. 170,428 | 9/1953 | Peterson | D8/14.1 |
| D. 181,600 | 12/1957 | Nilsson | D62/2 |
| D. 246,221 | 1/1977 | Cox | D8/14.1 |
| D. 285,895 | 9/1986 | Cox | D8/14.1 |
| 2,530,327 | 11/1950 | Derrick | 222/102 |
| 2,634,889 | 4/1953 | Sherbondy | 222/391 |
| 2,652,955 | 9/1953 | Crewe | 222/391 |
| 3,985,273 | 10/1976 | Davis, Jr. | 222/326 |
| 3,987,939 | 10/1976 | Pedone, Jr. et al. | 222/325 |
| 4,270,672 | 6/1981 | Kraals | 222/95 |
| 4,624,394 | 11/1986 | Ushiro | 222/391 |

FOREIGN PATENT DOCUMENTS

| | | | |
|---|---|---|---|
| 2020385 | 11/1971 | Fed. Rep. of Germany | 222/101 |
| 2942907 | 5/1981 | Fed. Rep. of Germany | 222/95 |

*Primary Examiner*—Joseph J. Rolla
*Assistant Examiner*—Kenneth Noland
*Attorney, Agent, or Firm*—Jerry T. Kearns

[57] ABSTRACT

A tube dispenser utilizes a ratchet actuated pusher for squeezing the contents from a tube. In a first embodiment, a tube is supported on a support plate with a nozzle of the tube extending through an aperture formed in an end wall connected to the support plate. A handle, mounted on an opposite end wall, has an attached ratchet actuation lever. A toothed rod extends through an aperture in the end wall adjacent the handle. A pair of frame rods extend betwen the end walls. By squeezing the ratchet actuation lever, the pusher is caused to advance along the support plate, squeezing the tube walls between the pusher and the support plate. Three different configurations of the pusher are disclosed. The pusher may be formed as a cylindrical bar, a right angle channel, or as a plurality of rotatable rollers. In a second embodiment, the tube is supported within a receptacle, with a nozzle of the tube extending through an aperture in an end wall of the receptacle. A plurality of rotatable rollers are mounted in a triangular configuration for sliding movement along a partition floor of the receptacle. A squeezing slot is formed between the rollers. A toothed bar in conjunction with a ratchet lever are utilized to advance the rollers along the partition floor of the receptacle, thus dispensing the tube contents.

2 Claims, 5 Drawing Sheets

TUBE DISPENSER

BACKGROUND OF THE INVENTION

1. Field of the Invention

The present invention relates to tube dispensers, and more particularly pertains to a dispenser for squeezing the contents from different types of tubes in a controlled fashion. A variety of products such as tub and tile caulk are sold in squeezable tubes. Presently, no dispenser is available to inexpensively, conveniently and accurately dispense the contents of such tubes at a desired rate on a specific location. In order to solve this problem, the present invention provides a simple ratchet actuated dispenser for squeezing the contents from these types of tubes.

2. Description of the Prior Art

Various types of tube dispensers are known in the prior art. A typical example of such a tube dispenser is to be found in U.S. Pat. No. 3,987,939, which issued to M. Pedone, Jr. et al on Oct. 26, 1976. This patent discloses a caulking gun for use with conventional disposable cartridges. Such cartridges comprise a tube formed of coated cardboard which is filled with a material to be extruded. One end of the tube is open and is fitted with a plunger which is separate from the tube and which is adapted to be pushed through the tube to extrude the material from the opposite end. That opposite end is fitted with a metal closure having an integral nozzle. To dispense the extruded material, the user first snips off the end of the integral nozzle at a point which will produce a desired bead thickness. The user then punctures the seal through the now open nozzle and then actuates the caulking gun to extrude the material. This type of conventional caulking gun is not suitable for use with squeeze type tubes. U.S. Pat. No. 3,985,273, which issued to G. Davis, Jr. on Oct. 12, 1976, discloses a caulking gun for use with plunger type cartridges. The caulking gun is constructed as an adaptor for attachment to an electric hand drill. The drill actuates a sliding plunger to extrude material from the cartridge. This dispenser is not suitable for use with squeeze type tubes. U.S. Pat. No. Des. 285,895, which issued to J. Cox on Sept. 30, 1986, discloses a plunger type caulking gun for use with disposable plunger type cartridges. A pivotal ratchet actuation lever is utilized to advance a plunger to extrude material from a disposable cartridge. U.S. Pat. No. Des. 246,221, which issued to J. Cox on Nov. 1, 1977, discloses a caulking gun having a pivotal actuation lever for advancing a plunger to extrude material from disposable plunger type cartridges. U.S. Pat. No. Des. 170,428, which issued to W. Peterson on Sept. 15, 1953, discloses a caulking gun which utilizes a pivotal ratchet actuation lever for extending a toothed plunger rod to extrude material from disposable plunger type cartridges. U.S. Pat. No. Des. 181,600, which issued to G. Nilsson on Dec. 3, 1957, discloses a caulking gun which utilizes a pivotal actuation lever to advance a plunger rod to extrude material from a conventional disposable plunger type cartridges. The caulking gun has an enclosed cylindrical housing for receiving the disposable cartridge.

While the above mentioned devices are suited for their intended usage, none of these devices is suitable for dispensing material from a squeeze type tube of the type utilized with various types of tub and tile caulk. Inasmuch as the art is relatively crowded with respect to these various types of tube dispensers, it can be appreciated that there is a continuing need for and interest in improvements to such tube dispensers, and in this respect, the present invention addresses this need and interest.

SUMMARY OF THE INVENTION

In view of the foregoing disadvantages inherent in the known types of tube dispensers now present in the prior art, the present invention provides an improved tube dispenser. As such, the general purpose of the present invention, which will be described subsequently in greater detail, is to provide a new and improved tube dispenser which has all the advantages of the prior art tube dispensers and none of the disadvantages.

To attain this, representative embodiments of the concepts of the present invention are illustrated in the drawings and make use of a tube dispenser utilizes a ratchet actuated pusher for squeezing the contents from a tube. In a first embodiment, a tube is supported on an elongated support plate with a nozzle of the tube extending through a central aperture formed in an end wall perpendicularly connected to the support plate. A handle, mounted on an opposite end wall, has a pivotally attached ratchet actuation lever. An elongated toothed rod extends through an aperture in the end wall adjacent the handle. A pair of spaced parallel frame rods extend between the end walls. By squeezing the ratchet actuation lever, the pusher is caused to incrementally slidably advance along the tube support plate, squeezing the tube walls between the pusher and the support plate, thus causing the contents of the tube to be dispensed from the tube nozzle. Three different configurations of the pusher are disclosed. The pusher may be formed as a cylindrical bar, a right angle channel, or a plurality of rotatable rollers may be mounted on a pivotal yoke for forming a pusher element. In a second embodiment, the tube is supported within a tube support receptacle, with a nozzle of the tube extending through an aperture in an end wall of the receptacle. A plurality of rotatable rollers are mounted in a triangular configuration for sliding movement along a partition floor of the tube support receptacle. A tube squeezing slot is formed between the rollers. A toothed bar in conjunction with a pivotal ratchet actuation lever are utilized to incrementally advance the rollers along the partition floor of the tube support receptacle, thus causing the contents of the tube to be dispensed through the tube nozzle.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved tube dispenser which has all the advantages of the prior art tube dispensers and none of the disadvantages.

It is another object of the present invention to provide a new and improved tube dispenser which may be easily and efficiently manufactured and marketed.

It is a further object of the present invention to provide a new and improved tube dispenser which is of a durable and reliable construction.

An even further object of the present invention is to provide a new and improved tube dispenser which is susceptible of a low cost of manufacture with regard to both materials and labor, and which accordingly is then susceptible of low prices of sale to the consuming public, thereby making such tube dispensers economically available to the buying public.

Still yet another object of the present invention is to provide a new and improved tube dispenser which provides in the apparatuses and methods of the prior art some of the advantages thereof, while simultaneously overcoming some of the disadvantages normally associated therewith.

Still another object of the present invention is to provide a new and improved tube dispenser which utilizes a ratchet actuated slidable pusher for accurately dispensing material from squeeze type tubes.

Yet another object of the present invention is to provide a new and improved tube dispenser which utilizes a plurality of rotatable rollers mounted on a pivotal yoke to squeeze the contents from the tube.

Even still another object of the present invention is to provide a new and improved tube dispenser which utilizes a ratchet mechanism to incrementally advance a pusher element formed from a plurality of rotatable rollers mounted on a pivotal yoke to economically and accurately dispense the contents from the nozzle of a squeezable tube.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
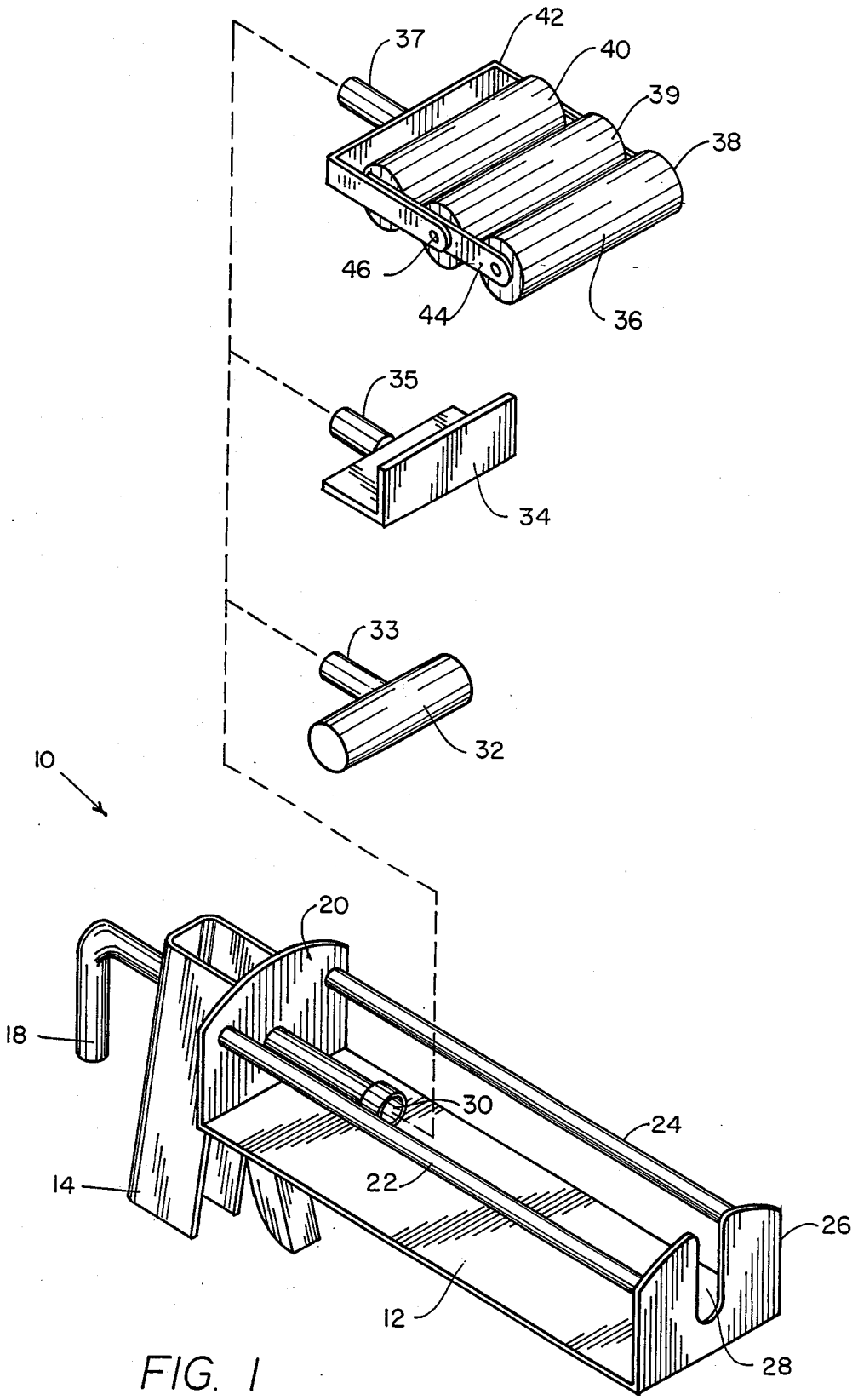
FIG. 1 is an exploded perspective view of a tube dispenser according to a first embodiment of the present invention, illustrating three different types of pusher elements.

With reference now to the drawings, and in particular to FIG. 1 thereof, a new and improved tube dispenser embodying the principles and concepts of the present invention and generally designated by the reference numeral 10 will be described.

More specifically, it will be noted that the first embodiment 10 of the invention includes a tube support plate 12. Front 26 and rear 20 end walls are perpendicularly connected to opposite ends of the tube support plate 12. A pair of elongated cylindrical frame rods 22 and 24 extend between the end walls 26 and 20. A tube nozzle receiving aperture 28 is centrally formed in the front end wall 26. It should be understood that the aperture 28 may take the form of the illustrated slot or may be formed as a circular hole. A handle 14 extends generally perpendicularly to the rear end wall 20, and is attached thereto. A ratchet actuation lever 16 is pivotally attached to the handle 14. An elongated toothed rod 18 is slidably received through the handle 14 and rear end wall 20. The toothed rod 18 may be incrementally advanced parallel to the tube support plate 12 by repeatedly squeezing and releasing the pivotal actuation lever 16. A pusher socket 30 disposed on an end of the toothed rod 18 overlying the support plate 12, is adapted to receive a stem of a pusher element. The socket 30 may frictionally engage the stem of a pusher element, or a set screw or other conventional securing device may be utilized. The present invention contemplates three alternative constructions of the pusher element. A first pusher element is in the form of a cylindrical bar 32 having a transversely attached cylindrical stem 33 adapted to be received in the socket 30. In a second, alternative form, the pusher element is formed as a right angle channel 34 having an attached cylindrical pusher stem 35. A third form of pusher element 36 utilizes three rollers 38, 39, 40, which are rotatably mounted between spaced roller mounting bars 44. A pivot yoke 42 is pivotally connected at a central portion 46 to each of the roller mounting bars 44. A cylindrical pusher stem 37 is transversely connected to the pivot yoke 42. In use, the selected form of pusher element is mounted in the socket 30. A tube of material to be utilized is inserted between the frame rods 22 and 24, with the nozzle of the tube extending through the aperture 28. The selected pusher element is then caused to incrementally slide along the tube support plate 12, by actuating the lever 16. The tube walls will be squeezed between the pusher element and the support plate 12, thus causing the contents to be dispensed from the tube nozzle.

Figure 2:
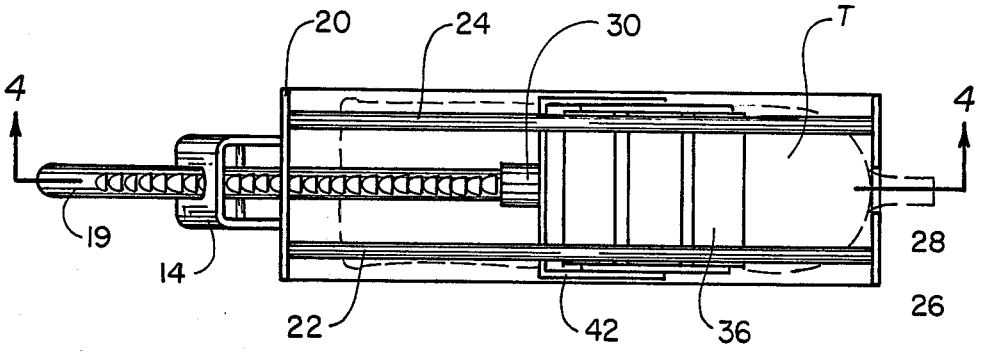
FIG. 2 is a top view of the tube dispenser of FIG. 1, incorporating the roller pusher element.

In FIG. 2, a top view of the tube dispenser of Figure 1 is illustrated. The roller pusher element 36 is in use to dispense the contents from a tube T. A plurality of ratchet teeth are spaced along the length of the toothed rod 18. The rod 18, in use, is rotated to face the teeth 19 downwardly, into engagement with an end of the actuation lever 16.

Figure 3:
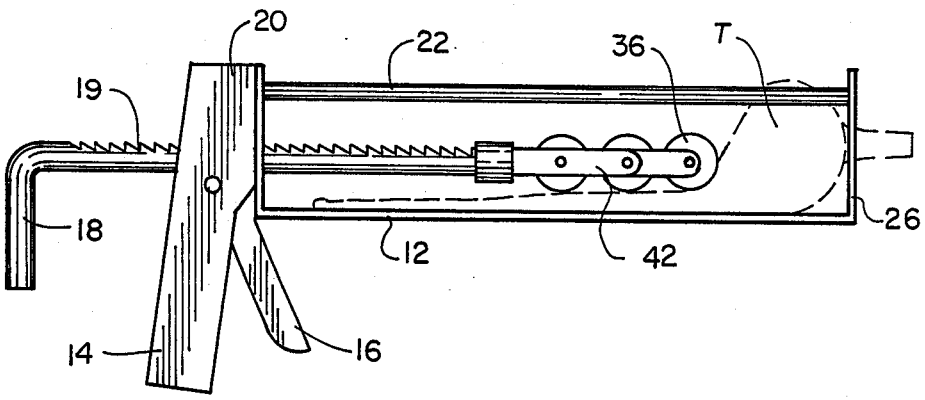
FIG. 3 is a side view of the tube dispenser of FIG. 2.

In FIG. 3, a side view of the tube dispenser of the first embodiment of the present invention is illustrated, showing a tube T, squeezed between the roller pusher element 36 and the tube support plate 12. The pivot yoke 42 of the roller pusher element 36 allows the rollers to conform to the thickness of the tube T, ensuring an efficient and complete dispensing of the contents thereof. When the rod 18 is in the illustrated position, with the ratchet teeth 19 facing upwardly, the rod 18 may be manually positioned along the length of the support plate 12. When utilizing the ratchet lever 16 to dispense a desired quantity of the contents of the tube T, the rod 18 will be rotated one hundred eighty degrees with respect to the illustrated position, facing the ratchet teeth 19 downwardly, into engagement with an upper end of the lever 16.

Figure 4:
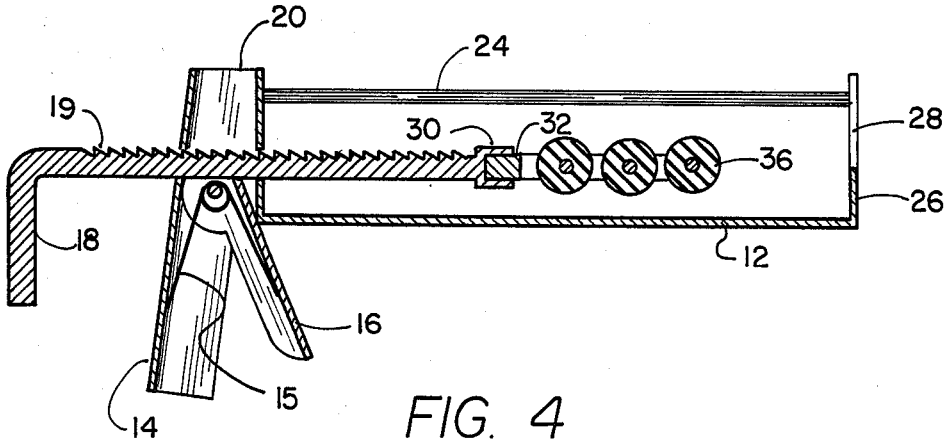
FIG. 4 is a longitudinal cross sectional view, taken along line 4—4 of FIG. 2, illustrating the tube dispenser according to the first embodiment of the present invention incorporating the roller pusher element.

FIG. 4 illustrates a longitudinal cross sectional view of the first embodiment of tube dispenser of the present invention, with the roller pusher element 36 in use. A spring 15 has one end abutting the handle 14 and another end in abutment with the lever 16, for urging the lever 16 away from the handle 14.

Figure 5:
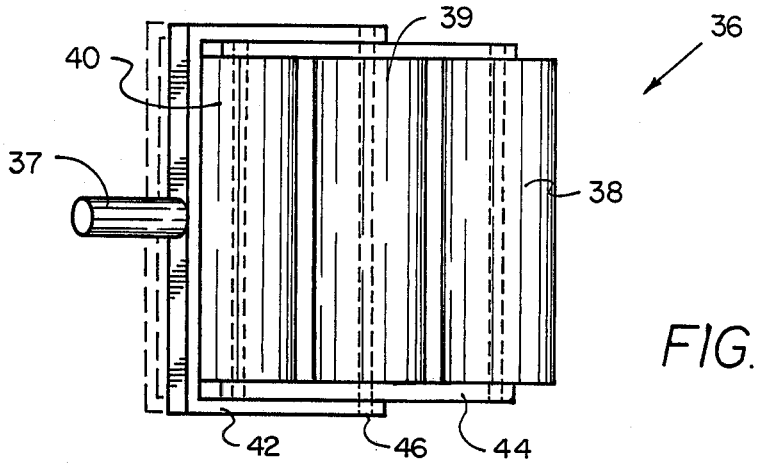
FIG. 5 is a perspective view of the roller pusher element.

In FIG. 5, a detail view of the roller pusher element 36 is provided. Three rollers, 38, 39 and 40 have axles rotatably mounted to spaced opposed parallel roller mounting bars 44. The roller mounting bars 44 are pivotally connected at their mid points 46 to a pivot yoke 42. A cylindrical stem 37 is connected as illustrated to the pivot yoke 42, for securing the roller pusher element 36 to the socket 30 of the toothed rod 18.

Figure 6:
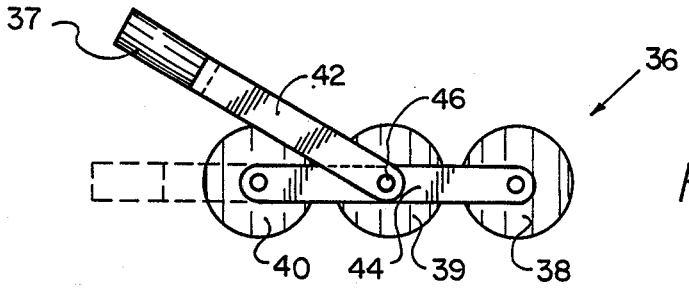
FIG. 6 is a side view of the roller pusher element.

In FIG. 6, the range of movement of the pivot yoke 42 is illustrated in dotted lines.

Figure 7:
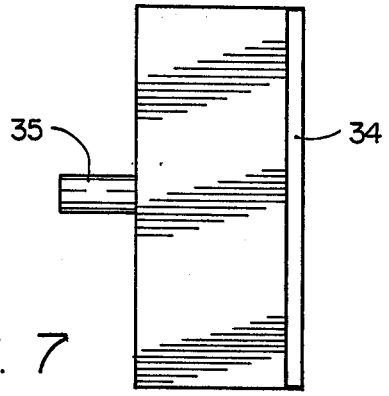
FIG. 7 is a top view of the right angle channel pusher element.

In FIG. 7, a top view of the right angle channel pusher element 34 is provided.

Figure 8:
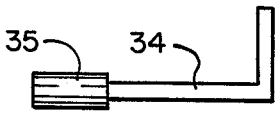
FIG. 8 is a side view of the right angle channel pusher element.

In FIG. 8, a side view of the right angle channel pusher element 34 is provided.

Figure 9:
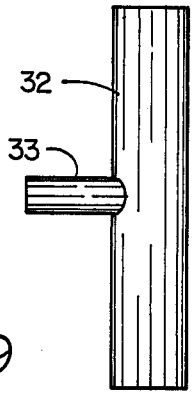
FIG. 9 is a top view of the cylindrical bar pusher element.

In FIG. 9, a top view of the cylindrical bar pusher element 32 is depicted.

Figure 10:
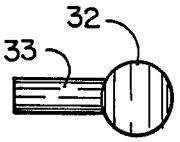
FIG. 10 is a side view of the cylindrical bar pusher element.

In FIG. 10, a side view of the cylindrical bar pusher element 32 is depicted.

Figure 11:
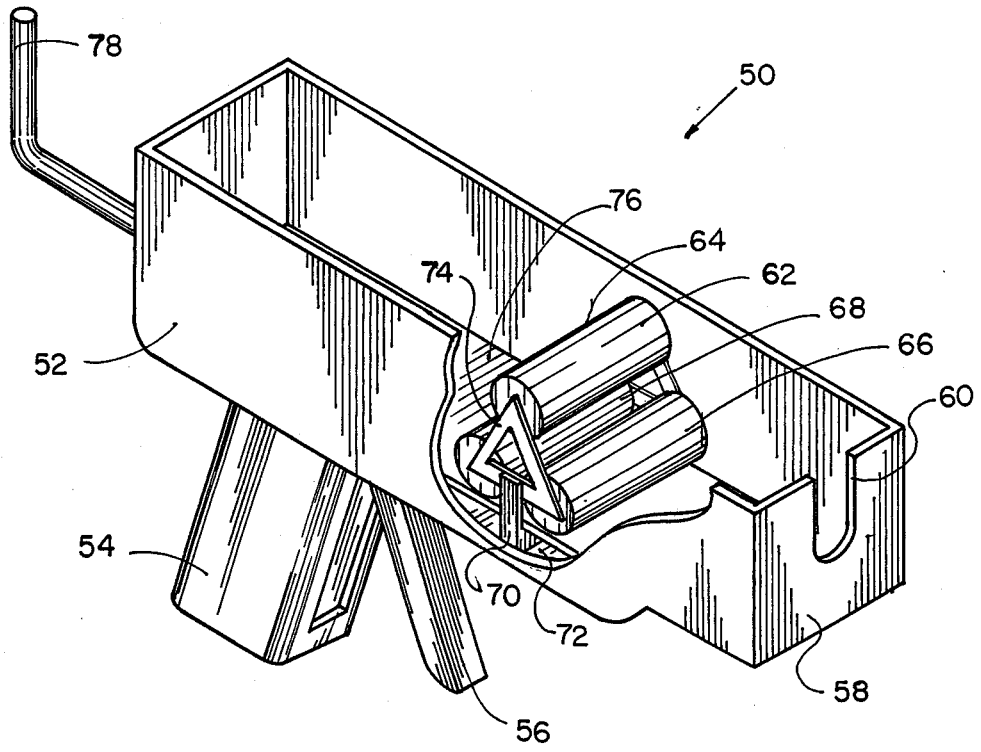
FIG. 11 is a perspective view of the tube dispenser according to the second embodiment of the present invention.

In FIG. 11, a second embodiment of the tube dispenser according to the present invention is illustrated. More specifically, the second embodiment 50 includes a generally rectangular tube support receptacle 52 having a generally perpendicularly attached handle 54. A ratchet actuation lever 56 is pivotally attached to the handle 54. A front end wall of the receptacle 52 is provided with a central aperture 60 for the reception of a squeezable tube nozzle. A triangular roller pusher assembly 62 includes an upper roller 64, a front lower roller 66 and a rear lower roller 68. A slide yoke 70 is received for longitudinal sliding movement in an elongated channel formed between a bottom wall 72 and a partition floor 76. A pair of parallel opposed spaced triangular roller support mounts 74 are secured to opposite sides of the slide yoke 70. Each of the rollers 64, 66 and 68 are rotatably mounted between opposed apexes of the triangular roller support mounts 74. A tube squeezing slot is formed between the upper roller 64 and the two lower rollers 66 and 68. The slide yoke 70 is connected to a toothed rod 78 which is provided with ratchet teeth for cooperative engagement with the ratchet actuation lever 56. In use, a tube is positioned in the receptacle 52, with the nozzle of the tube extending through the aperture 60. The opposite end of the tube is received in the slot formed between the rollers. By incrementally advancing the slide yoke 70 along the partition floor 76, the rollers 64, 66 and 68 are caused to dispense the desired quantity of the contents of the squeezable tube.

Figure 12:
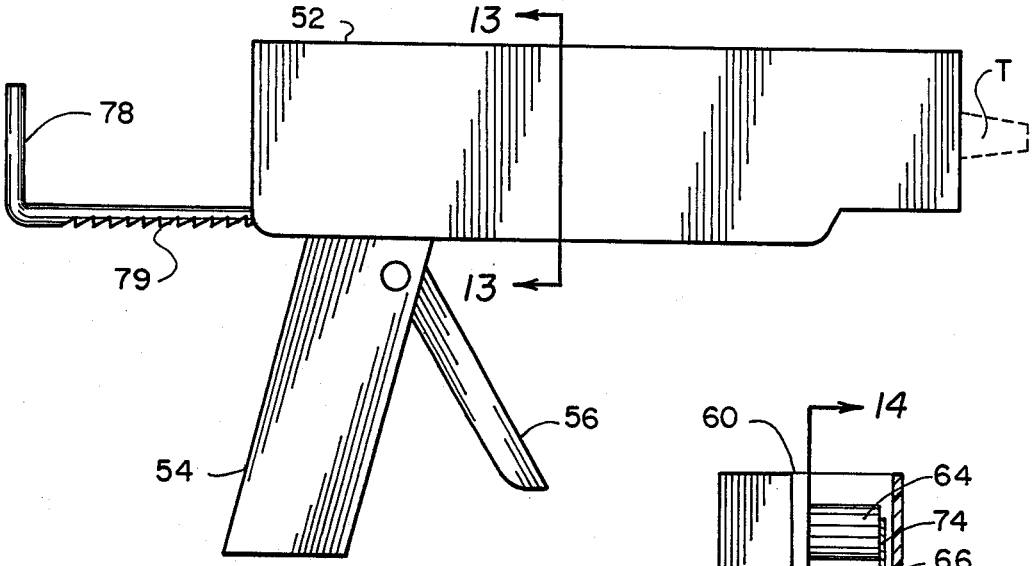
FIG. 12 is a side view of the tube dispenser of FIG. 11.

In the side view of FIG. 12, the ratchet teeth 79 on the underside of the toothed rod 78 are illustrated. The nozzle of a squeezable tube T is shown extending from the aperture 60.

Figure 13:
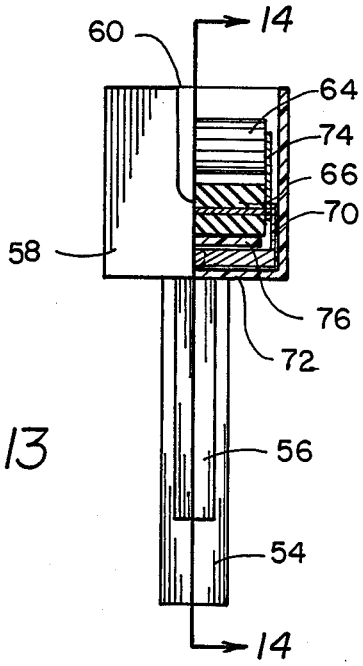
FIG. 13 is a transverse cross sectional view, taken along line 13—13 of FIG. 12, illustrating the internal construction of the tube dispenser according to the second embodiment of the present invention.

In FIG. 13, a partial cross sectional view illustrates the internal construction of the tube dispenser according to the second embodiment 50 of the present invention. As shown, the slide yoke 70 is received for sliding movement in an elongated channel formed between the bottom wall 72 and the partition floor 76.

Figure 14:
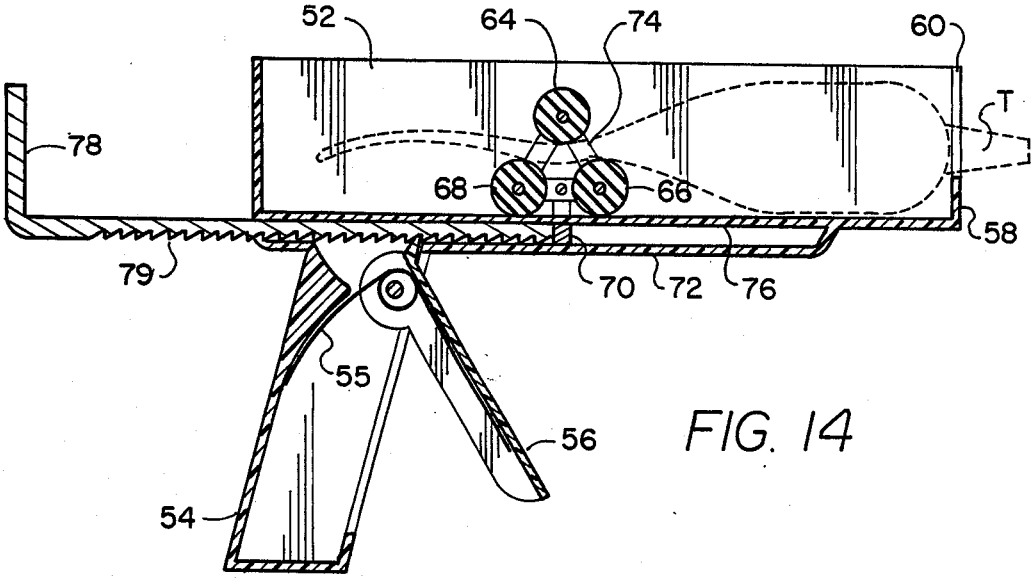
FIG. 14 is a longitudinal cross sectional view, taken along line 14—4 of FIG. 13, illustrating the tube dispenser according to the second embodiment of the present invention.

In FIG. 14, a longitudinal cross sectional view is provided, which illustrates the ratchet mechanism for incrementally advancing the slide yoke 70. An upper end of the ratchet actuation lever 56 is in engagement with the teeth 79 on the rod 78. A spring 55 has a first end in engagement with the handle 54 and an opposite end in engagement with the lever 56, for biasing the lever 56 to the illustrated position, away from the handle 54. In use, the nozzle of the tube T extends outwardly from the front end wall 58 of the receptacle 52 through the aperture 60. The opposite end of the tube T extends through a narrow tube squeezing slot formed between the upper roller 64 and the lower roller 66 and 68. By incrementally advancing the slide yoke 70 toward the front end wall 58 of the receptacle 52, the contents of the tube T may be accurately dispensed in the desired quantity.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationship to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved tube dispenser, comprising:
a generally rectangular tube support receptacle;
a tube support partition floor in said receptacle;
a front end wall perpendicularly connected adjacent a front end of said tube support receptacle;
a tube nozzle receiving aperture formed centrally in said front end wall;
a bottom wall spaced from and extending parallel to said tube support partition floor, forming an elongated channel;
an elongated toothed rod slidably received in said channel;
a handle connected to said bottom wall, said handle extending generally perpendicular to said bottom wall;
a ratchet actuation lever pivotally mounted on said handle, said ratchet actuation lever having one end positioned for engagement with said toothed rod;
a spring abutting said handle and said ratchet actuation lever for urging said lever away from said handle;
a slide yoke mounted on an end of said toothed rod, said slide yoke mounted for sliding movement in said channel;
a pair of parallel triangular roller support mounts connected to said slide yokes on opposite sides of said partition floor, said triangular roller support mounts extending generally perpendicular to said partition floor;
three rollers rotatably mounted on said triangular roller support mounts, each of said rollers having opposite ends mounted adjacent an apex of each of said triangular roller support mounts; and
a tube squeezing slot formed between said rollers.

2. A new and improved tube dispenser, comprising:
an elongated tube support plate;
a front end wall perpendicularly connected adjacent a front end of said tube support plate;
a tube nozzle receiving aperture formed centrally in said front end wall;
a rear end wall perpendicularly connected adjacent a rear end of said tube support plate;
a pair of transversely spaced elongated parallel frame rods extending between said front and rear end walls, said frame rods extending parallel to said tube support plate;
an elongated toothed rod slidably received through a central aperture in said rear end wall, said toothed rod having a plurality of spaced teeth thereon;
a handle connected to said rear end wall, said handle extending generally perpendicular to said tube support plate;
a ratchet actuation lever pivotally mounted on said handle, said ratchet actuation lever having one end positioned for engagement with said toothed rod;
a spring abutting said handle and said ratchet actuation lever for biasing said lever away from said handle;
a pusher socket formed on an end of said elongated toothed rod overlying said tube support plate;
a pusher having a cylindrical stem received in said pusher socket, said pusher mounted for sliding movement along said tube support plate;
said pusher comprising a plurality of rollers rotatably mounted between a pair of mounting bars; and
a pivot yoke pivotally connected to said mounting bars.

* * * * *